US009290964B2

(12) United States Patent
Trent et al.

(10) Patent No.: US 9,290,964 B2
(45) Date of Patent: Mar. 22, 2016

(54) LOCK ASSEMBLY HAVING FIRE RESISTANT SPINDLE LINKAGE

(71) Applicant: Stanley Security Solutions, Inc., Indianapolis, IN (US)

(72) Inventors: Bradley Trent, Noblesville, IN (US); Chad A. Hickman, Rensselaer, IN (US); Simon Marin, Indianapolis, IN (US); Bret Holbrook, Indianapolis, IN (US)

(73) Assignee: Stanley Security Solutions, Inc., Indianapolis, IN (US)

( * ) Notice: Subject to any disclaimer, the term of this patent is extended or adjusted under 35 U.S.C. 154(b) by 324 days.

(21) Appl. No.: 14/106,969

(22) Filed: Dec. 16, 2013

(65) Prior Publication Data

US 2014/0165672 A1 Jun. 19, 2014

Related U.S. Application Data

(60) Provisional application No. 61/738,984, filed on Dec. 18, 2012.

(51) Int. Cl.

| | |
|---|---|
| ***E05B 65/06*** | (2006.01) |
| ***E05B 15/00*** | (2006.01) |
| ***E05B 17/00*** | (2006.01) |
| *E05B 1/00* | (2006.01) |
| *E05B 15/16* | (2006.01) |
| *E05B 65/10* | (2006.01) |

(52) U.S. Cl.

CPC ..... *E05B 15/0033* (2013.01); *E05B 17/0075* (2013.01); *E05B 1/003* (2013.01); *E05B 15/16* (2013.01); *E05B 65/104* (2013.01); *Y10T 70/5372* (2015.04)

(58) Field of Classification Search

CPC ..... E05B 1/003; E05B 13/002; E05B 13/004; E05B 15/0033; E05B 15/16; E05B 17/0004; E05B 17/0075; E05B 17/2084; E05B 65/104; Y10S 292/65; Y10S 292/66

See application file for complete search history.

(56) References Cited

U.S. PATENT DOCUMENTS

| | | | | |
|---|---|---|---|---|
| 4,502,720 | A * | 3/1985 | Fayerman | E05B 65/104 292/169.16 |
| 4,667,994 | A * | 5/1987 | Foshee | E05B 63/16 292/1 |
| 4,728,133 | A * | 3/1988 | Valley | E05B 3/06 292/336.3 |
| 5,380,053 | A * | 1/1995 | Saino | E05B 65/104 292/144 |
| 5,527,074 | A * | 6/1996 | Yeh | E05B 65/104 292/177 |
| 7,488,012 | B2 * | 2/2009 | Eller | E05B 65/104 292/137 |
| 8,523,248 | B2 * | 9/2013 | Tien | E05B 65/1006 292/194 |
| 8,702,132 | B2 * | 4/2014 | Tien | E05B 65/104 292/219 |
| 8,881,637 | B2 * | 11/2014 | Leites | E05B 65/104 137/75 |

* cited by examiner

*Primary Examiner* — Christopher Boswell

(74) *Attorney, Agent, or Firm* — Richard J. Veltman; Adan Ayala

(57) ABSTRACT

A lock assembly includes an exterior operator assembly, an interior operator assembly, and a latch assembly. An outer spindle is operatively coupled to a latch assembly, is drivably coupled to the interior operator assembly, and has a longitudinal bore. A coupling mechanism is coupled to the outer spindle. A locking spindle assembly is rotatably received in the longitudinal bore, and is configured to selectively operate the coupling mechanism to couple the exterior operator assembly to the outer spindle upon actuation of a drive assembly. The locking spindle assembly has a fire compliant component made of a first material that melts during a fire to prevent operation of the latch assembly with the exterior operator assembly, and has a fire resistant component made of a second material and configured to block the longitudinal bore of the outer spindle to aid in preventing the spread of the fire through the door.

20 Claims, 6 Drawing Sheets

LOCK ASSEMBLY HAVING FIRE RESISTANT SPINDLE LINKAGE

CROSS-REFERENCE TO RELATED APPLICATIONS

This is a non-provisional application based upon U.S. provisional patent application Ser. No. 61/738,984, entitled "LOCK ASSEMBLY HAVING FIRE RESISTANT SPINDLE LINKAGE", filed Dec. 18, 2012, from which priority is claimed, and which is incorporated herein by reference in its entirety.

BACKGROUND OF THE INVENTION

1. Field of the Invention

The present invention relates to door locks, and, more particularly, to a lock assembly having a fire resistant spindle linkage.

2. Description of the Related Art

Some doors and associated lock assemblies, such as those used in commercial buildings, are designed to aid in protecting against the spread of fire by preventing the passage of fire from one room to another. In order to do so, a lock assembly may be designed to ensure that the associated door is maintained in a closed and latched state in the event of fire. In some such lock assemblies, pivot joints in the latch actuation linkage may be designed with internal fusible links which may be melted at fire temperatures to render the latch actuation linkage nonfunctional, and thus the door remains latched. In some situations, however, one or more passageways through the lock mechanism may be open, or become opened as a result of the fire, which potentially may not adequately inhibit the spread of fire.

What is needed in the art is a lock assembly having a fire resistant spindle linkage. The present invention provides such a solution.

SUMMARY OF THE INVENTION

The present invention provides a lock assembly having a fire resistant spindle linkage.

The invention, in one form thereof, is directed to a lock assembly for a door. The lock assembly includes an exterior operator assembly having an exterior operator handle, an interior operator assembly having an interior operator handle, and a latch assembly having a bolt actuator mechanism and a bolt. An outer spindle is operatively coupled to the latch assembly and is drivably coupled to the interior operator assembly. The outer spindle has a longitudinal bore. A coupling mechanism is drivably coupled to the outer spindle. A drive assembly is configured to provide a driving rotation. A locking spindle assembly is rotatably received in the longitudinal bore, is drivably engaged with the drive assembly, and is configured to selectively operate the coupling mechanism to drivably couple the exterior operator assembly to the outer spindle upon actuation of the drive assembly. The locking spindle assembly has a fire compliant component made of a first material that melts during a fire to prevent operation of the latch assembly with the exterior operator assembly, and has a fire resistant component made of a second material having a higher melting temperature from that of the first material and configured to block the longitudinal bore of the outer spindle to aid in preventing the spread of the fire through the door via the longitudinal bore.

The invention, in another form thereof, is directed to a spindle assembly for use in a lock assembly. The spindle assembly includes an outer spindle having a longitudinal bore. A locking spindle assembly is rotatably received in the longitudinal bore of the outer spindle. The locking spindle assembly has a fire compliant component and a fire resistant component. The fire compliant component is made of a first material that melts in the event of a fire. The fire resistant component is made from a second material having a higher melting temperature than that of the first material and is configured to block the longitudinal bore of the outer spindle after the melting of the fire compliant component to aid in preventing the spread of the fire through the longitudinal bore.

The invention, in another form thereof, is directed to a lock assembly for use with a door. The lock assembly includes an exterior operator assembly having an exterior operator handle, an interior operator assembly having an interior operator handle, and an electronics assembly including a credential reader and a motor drive assembly electrically coupled to the credential reader. The credential reader is configured to selectively actuate the motor drive assembly. A latch assembly has a bolt actuator mechanism and a bolt. An outer spindle is operatively coupled to the bolt actuator mechanism of the latch assembly, and is drivably coupled to the interior operator assembly. The outer spindle has a longitudinal bore. A coupling mechanism is drivably coupled to the outer spindle, and is configured to selectively couple the exterior operator assembly to the outer spindle. A locking spindle assembly is rotatably received in the longitudinal bore of the outer spindle. The locking spindle includes a locking spindle tail member, a locking actuator spindle, and a locking spindle link. The locking spindle tail member has a first portion configured to be received in the longitudinal bore of the outer spindle. The locking spindle tail member is drivably coupled to the motor drive assembly. The locking actuator spindle has a second portion configured to be received in the longitudinal bore of the outer spindle. The locking actuator spindle is configured to selectively operate the coupling mechanism to drivably couple the exterior operator assembly to the outer spindle upon actuation of the motor drive assembly. The locking spindle link has a first coupling portion configured to connect to the first portion of the locking spindle tail member and has a second coupling portion configured to connect to the second portion of the locking actuator spindle. The locking spindle link is positioned within the longitudinal bore of the outer spindle. Each of the locking spindle tail member and the locking actuator spindle is made of a first material configured to melt in the event of a fire. The locking spindle link is made of a second material having a higher melting temperature than the first material and is configured to block the longitudinal bore of the outer spindle to aid in preventing the spread of the fire through the door via the longitudinal bore of the outer spindle.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION OF THE INVENTION

Figure 1:
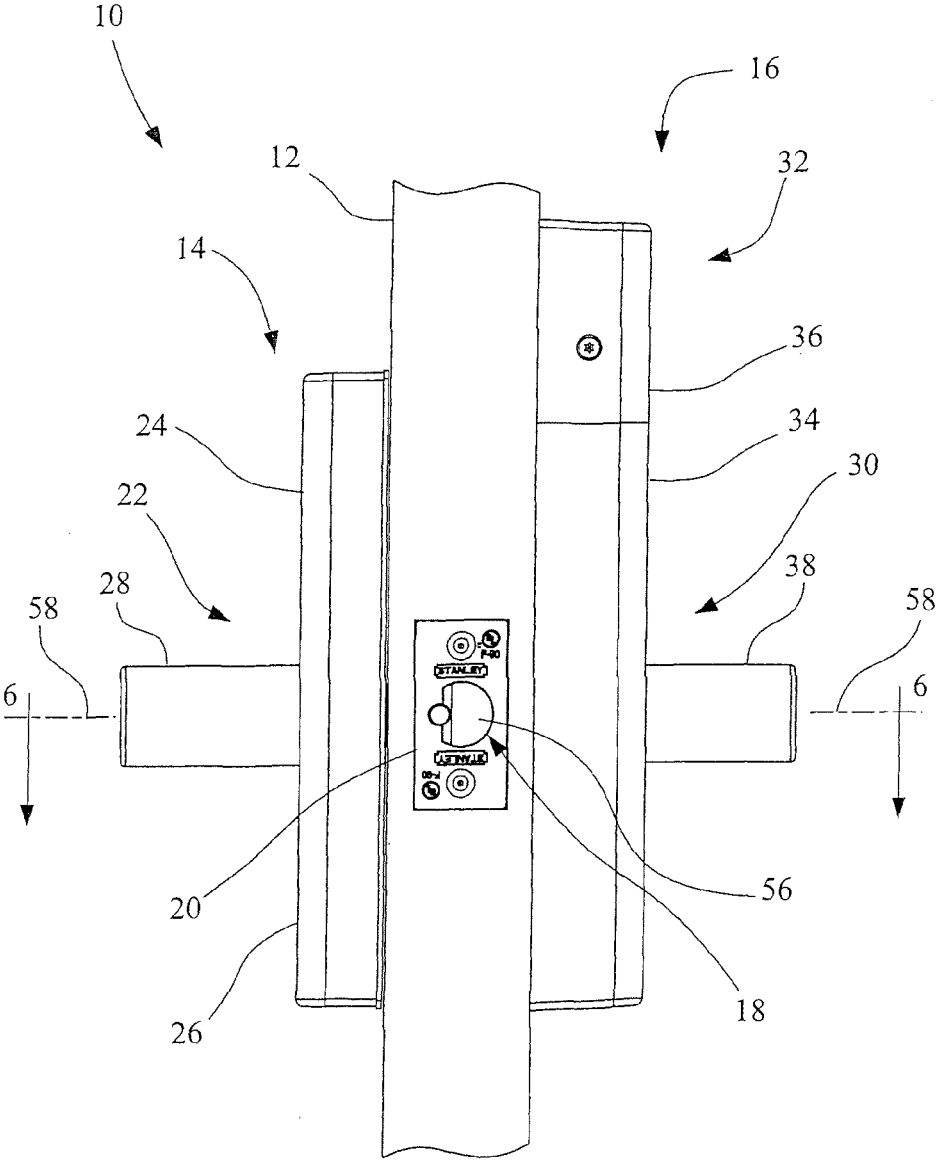
FIG. 1 is a door edge view of a lock assembly in accordance with an embodiment of the present invention, installed on a door.
Figure 2:
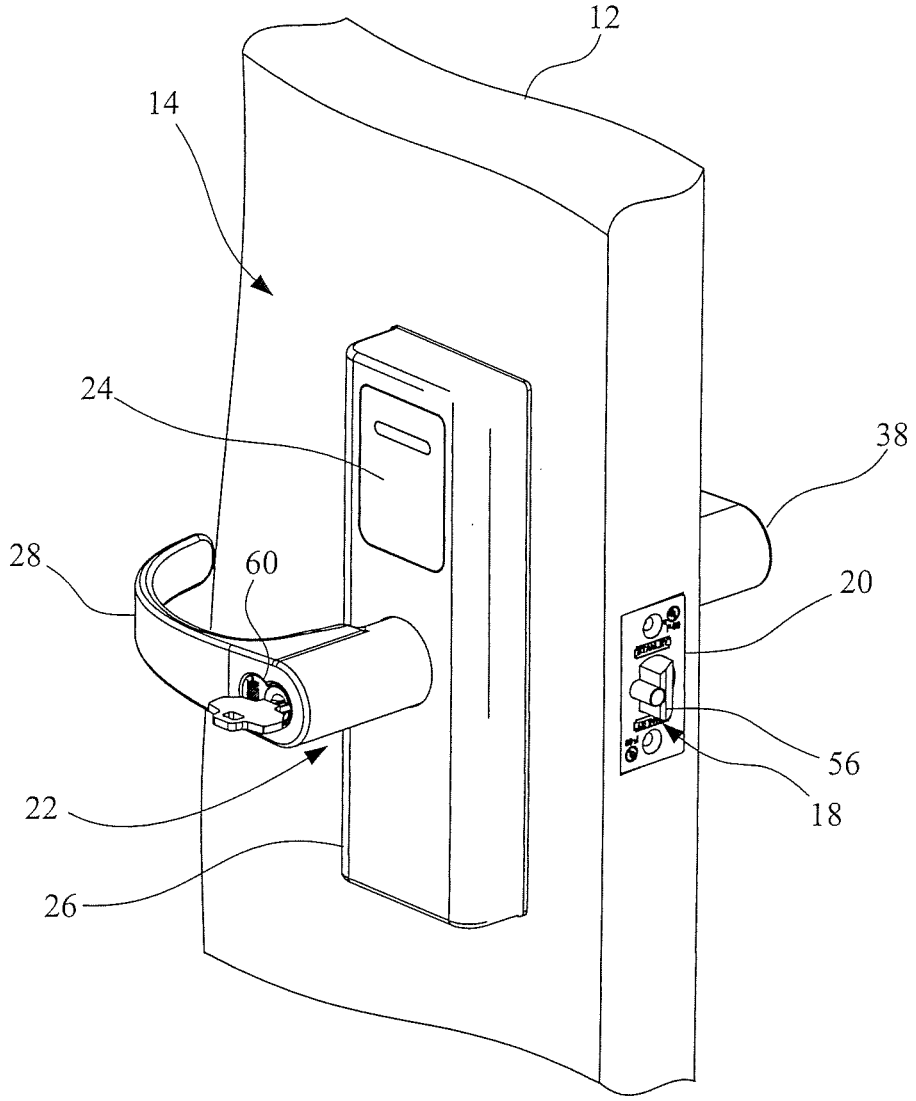
FIG. 2 is a perspective view of the exterior lockset of the lock assembly of FIG. 1, as viewed from the exterior of the door.
Figure 3:
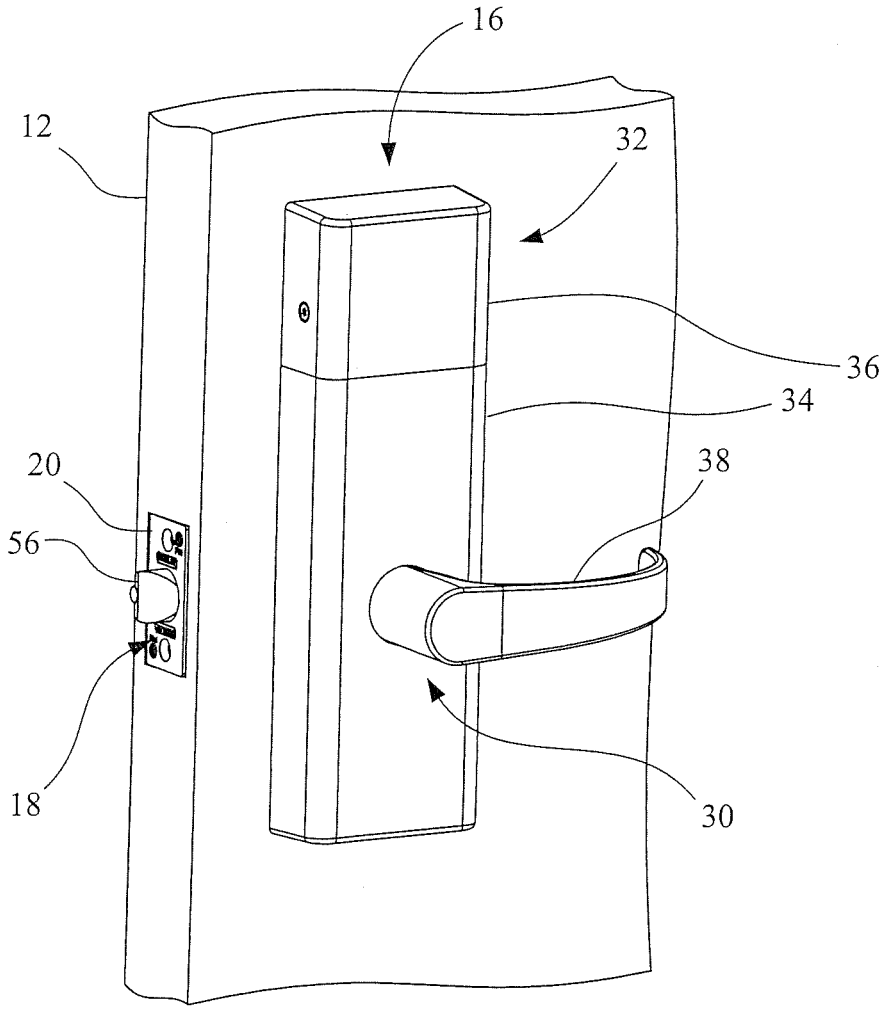
FIG. 3 is a perspective view of the interior lockset of the lock assembly of FIG. 1, as viewed from the interior of the door.

Referring now to the drawings and particularly to FIGS. 1-3, there is shown a lock assembly 10 in accordance with the present invention for mounting on a door 12, and which includes an exterior lockset 14, interior lockset 16, a latch assembly 18, and a strike 20.

Exterior lockset 14 includes an exterior operator assembly 22, a credential reader 24, and an exterior escutcheon 26. Exterior operator assembly 22 includes an exterior operator handle 28.

Interior lockset 16 includes an interior operator assembly 30, a control electronics module 32, an interior escutcheon 34 and a battery cover 36. Interior operator assembly 30 includes an interior operator handle 38. Control electronics module 32 is electrically connected to credential reader 24.

Figure 4:
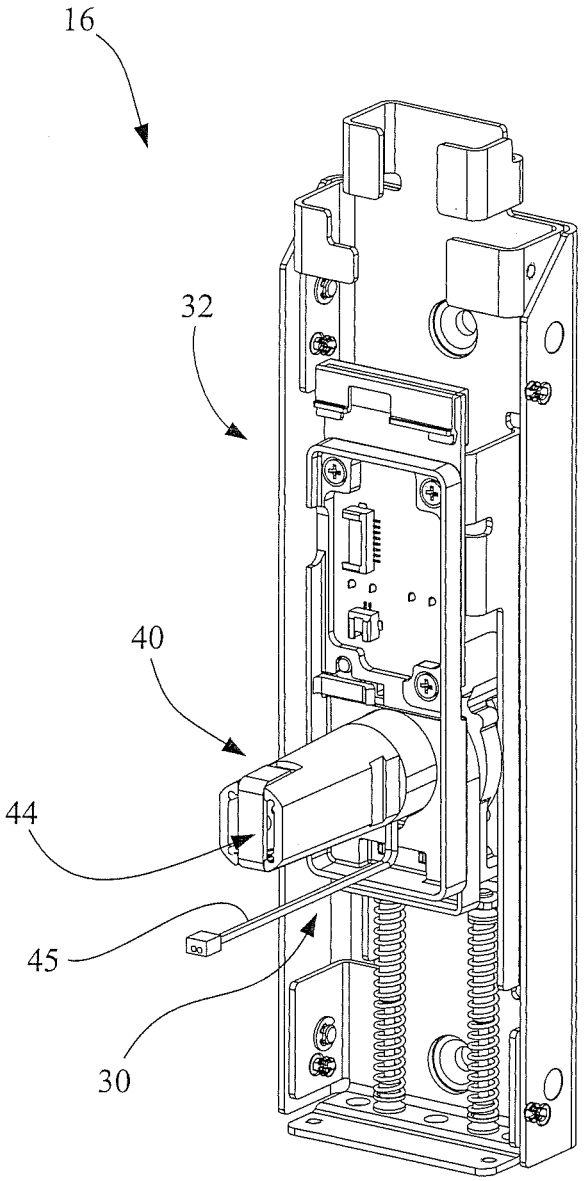
FIG. 4 is a perspective view of the interior lockset of FIG. 3, with the lever, escutcheon and battery cover removed.
Figure 5:
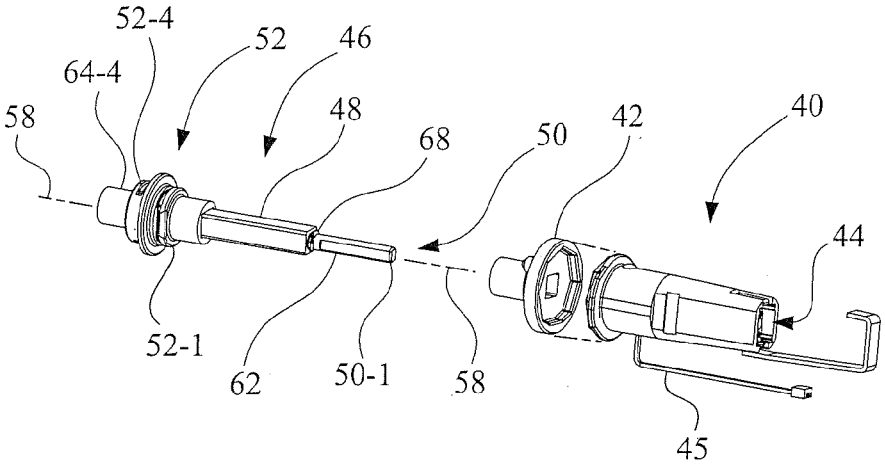
FIG. 5 is an exploded view of the handle sleeve assembly and spindle assembly of the lock assembly of FIG. 1.

Referring also to FIG. 4, interior operator assembly 30 includes a handle sleeve assembly 40. An exterior of handle sleeve assembly 40 is configured to mount interior operator handle 38. Referring also to FIG. 5, an exterior of handle sleeve assembly 40 is drivably coupled to an inside square drive spindle coupler 42. Within handle sleeve assembly 40 there is a chamber for mounting a motor drive assembly 44. Motor drive assembly 44 is electrically connected to control electronics module 32 via wire conductors 45.

Also shown in FIG. 5 is a spindle assembly 46 that includes an outer square spindle 48 within which there is rotatably received a locking spindle assembly 50. A coupling mechanism 52 is provided to selectively drivably couple exterior operator assembly 22 to outer square spindle 48. Locking spindle assembly 50 has a first end 50-1 that is mechanically coupled to a rotatable shaft of motor drive assembly 44. Locking spindle assembly 50 is operably coupled to coupling mechanism 52 to selectively couple and decouple exterior operator assembly 22 to outer square spindle 48, with the normal, or rest, state being a decoupled state.

Figure 6:
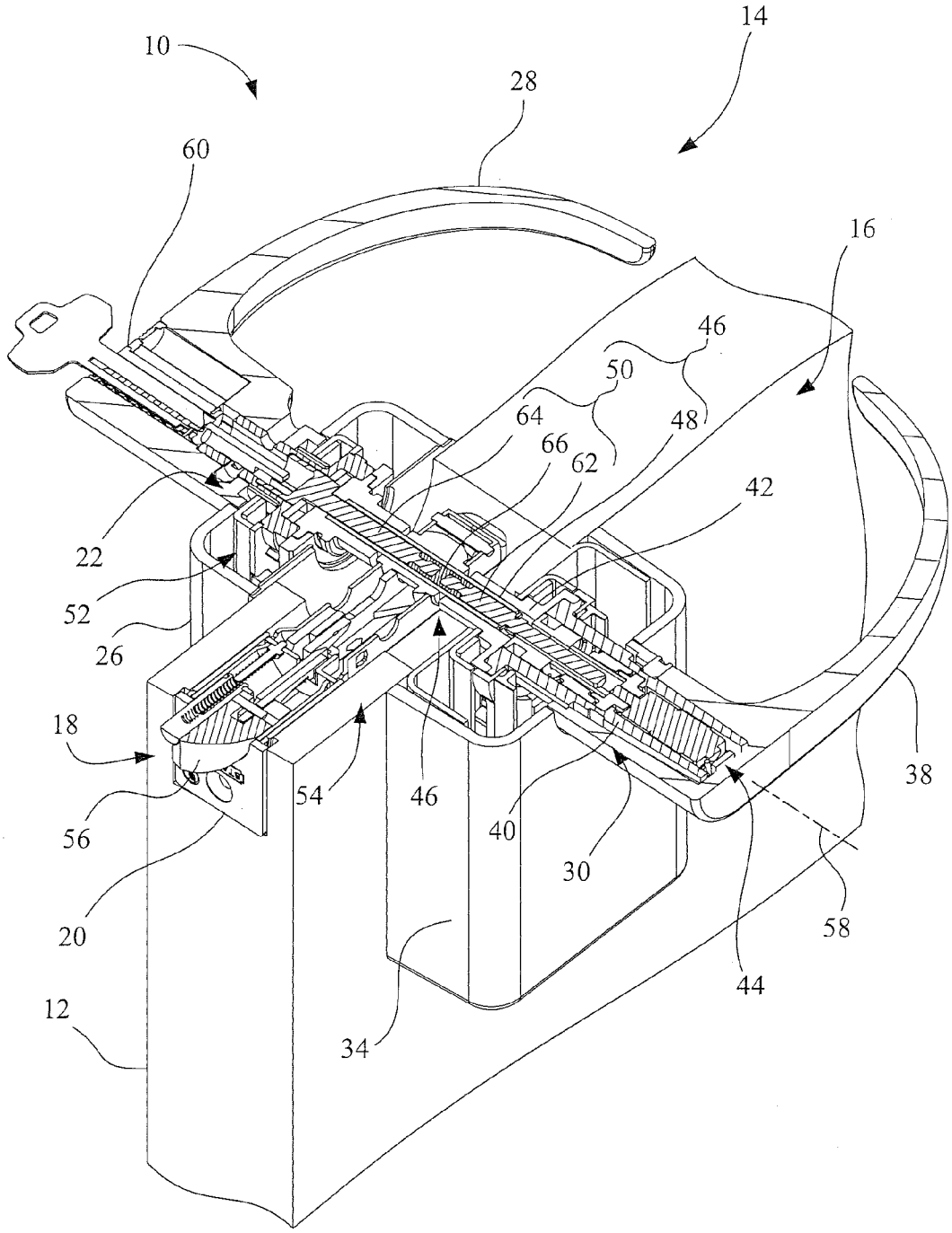
FIG. 6 is a sectioned perspective view of the lock assembly of FIG. 1 taken along plane 6-6 of FIG. 1.

Referring also to FIG. 6, latch assembly 18 is configured with a bolt actuator mechanism 54 and a retractable bolt 56, as is customary in the art. Bolt actuator mechanism 54 is operable by a rotation of outer square spindle 48 of spindle assembly 46 to retract bolt 56. As is illustrated in FIG. 6, exterior operator handle 28, interior operator handle 38, and spindle assembly 46 are longitudinally aligned along an axis 58.

Interior lockset 16 is configured such that during normal operation interior operator handle 38 is always operatively coupled to spindle assembly 46, and in particular, to outer square spindle 48 via inside square drive spindle coupler 42, and in turn to latch assembly 18. As such, in normal operation a rotation of interior operator handle 38 always will result in a retraction of bolt 56. Also, in normal operation motor drive assembly 44 is always operatively coupled to locking spindle assembly 50.

Referring to FIGS. 2 and 6, exterior lockset 14 is configured such that exterior operator handle 28 is selectively coupled to latch assembly 18. In a locked condition, exterior operator handle 28 is decoupled from spindle assembly 46, and thus a rotation of exterior operator handle 28 does not result in a retraction of bolt 56. In an unlocked condition, exterior operator handle 28 is coupled to spindle assembly 46 via coupling mechanism 52 to operate latch assembly 18, and thus a rotation of exterior operator handle 28 will result in a retraction of bolt 56.

The unlocked condition may be achieved by providing a valid credential, e.g., an RFID card, to be read by credential reader 24, which in turn sends a signal to control electronics module 32. Control electronics module 32 then compares the read credential to a database of stored authorized credentials, and if a match is found, responds by operating motor drive assembly 44 to rotate the inner portion, i.e., locking spindle assembly 50, of spindle assembly 46 to activate coupling mechanism 52 to couple exterior operator handle 28 to latch assembly 18 via coupling mechanism 52 and outer square spindle 48 (see also FIG. 5).

Additionally, exterior lockset 14 is provided with a mechanical override in the form of a key operated interchangeable keyed lock core 60 that is operatively coupled to coupling mechanism 52, such that a valid operator key may be used to effect a coupling of exterior operator handle 28 to latch assembly 18.

In accordance with an aspect of the present invention, locking spindle assembly 50 is provided with fire compliant and fire resistant components to both render lock assembly 10 inoperable by exterior lockset 14 in the event of a fire, and also to block a potential through hole through spindle assembly 46 to aid in preventing the spread of fire.

Figure 7:
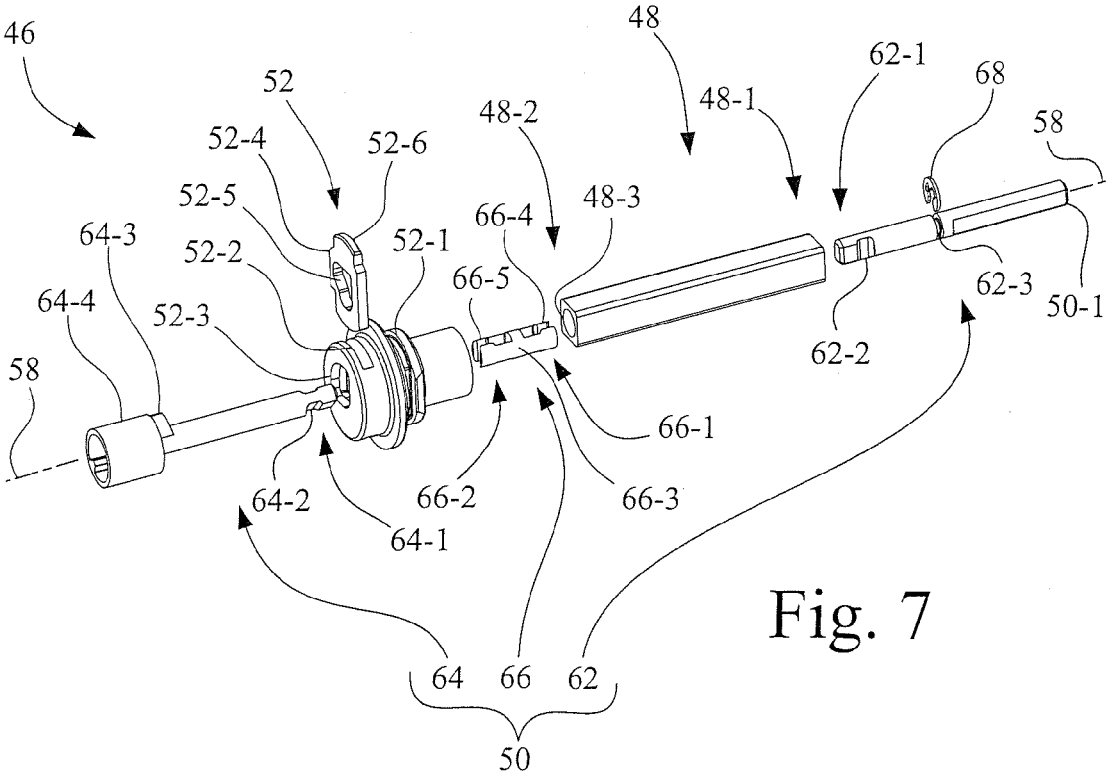
FIG. 7 is an exploded view of the spindle assembly of FIG. 5.

Referring now also to FIG. 7, spindle assembly 46 includes the outer square spindle 48. Square spindle 48 has a first end 48-1, a second end 48-2, and a longitudinal bore 48-3 that extends between first end 48-1, a second end 48-2. Longitudinal bore 48-3 of square spindle 48 is sized to rotatably receive locking spindle assembly 50. Second end 48-2 of square spindle 48 is configured to drivably connect to a body 52-1 of coupling mechanism 52.

Body 52-1 of coupling mechanism 52 includes a slot 52-2 and a longitudinal opening 52-3. Longitudinal opening 52-3 is co-axial with longitudinal bore 48-3 along axis 58. Slot 52-2 is arranged to perpendicularly intersect longitudinal opening 52-3. A slide member 52-4 is received in slot 52-2 in a sliding arrangement, such that slide member 52-4 is selectively extendable from body 52-1. Slide member 52-4 has a cam opening 52-5 and a coupling tab 52-6. Coupling tab 52-6 is configured to selectively engage a coupling portion of exterior operator assembly 22, such that when so engaged, exterior operator handle 28 is rotatably coupled to square spindle 48 to operate latch assembly 18.

Locking spindle assembly 50 is a three piece elongate sub-assembly, generally round in cross-section, which transfers a torque function that is required to lock and unlock lock assembly 10 via the lifting and lowering of slide member 52-4 of coupling mechanism 52. More particularly, locking spindle assembly 50 includes a locking spindle tail 62, a locking actuator spindle 64, and a locking spindle link 66. Each of locking spindle tail 62, locking actuator spindle 64, and locking spindle link 66 has a cylindrical exterior portion that is received in a snug rotating fit within the longitudinal bore 48-3 of square spindle 48.

Locking spindle tail 62 has a coupling end 62-1 having a pair of diametrically opposed surface recesses 62-2. Likewise, locking actuator spindle 64 has a coupling end 64-1 having a pair of diametrically opposed surface recesses 64-2. In addition, locking actuator spindle 64 includes a cam protrusion 64-3 that is configured to be received in cam opening 52-5 of body 52-1 of coupling mechanism 52, so as to raise or lower slide member 52-4 based on a rotational position of cam protrusion 64-3. A head portion 64-4 of locking actuator spindle 64 is located opposite coupling end 64-1, with cam protrusion 64-3 interposed between head portion 64-4 and coupling end 64-1, and with cam protrusion 64-3 adjacent head portion 64-4.

Locking spindle link 66 is configured as an H-shaped structure having a pair of axially opposed U-shaped clip ends 66-1 and 66-2 that are separated by an interposed solid core 66-3. U-shaped clip end 66-1 includes a pair of diametrically opposed inwardly facing protrusions 66-4 sized and configured to engage the corresponding pair of diametrically opposed surface recesses 62-2 of locking spindle tail 62 in an interlocking relationship and/or a snap fit, so as to connect locking spindle link 66 to locking spindle tail 62. U-shaped clip end 66-2 includes a pair of diametrically opposed inwardly facing protrusions 66-5 sized and configured to engage the corresponding pair of diametrically opposed surface recesses 64-2 of locking actuator spindle 64 in an interlocking relationship and/or a snap fit, so as to connect locking spindle link 66 to locking actuator spindle 64.

Referring particularly to FIG. 7, to assemble spindle assembly 46, coupling end 64-1 of locking actuator spindle 64 is inserted through longitudinal opening 52-3 of body 52-1 of coupling mechanism 52, and through cam opening 52-5 of slide member 52-4. Head portion 64-4 serves as a stop to engage coupling mechanism 52 to position cam protrusion 64-3 in cam opening 52-5 of slide member 52-4. Coupling end 64-1 of locking actuator spindle 64 is then connected to U-shaped clip end 66-2 of locking spindle link 66. Coupling end 62-1 of locking spindle tail 62 is then connected to U-shaped clip end 66-1 of locking spindle link 66.

Locking spindle assembly 50 is then inserted, first end 50-1 first, through longitudinal bore 48-3 of square spindle 48, such that second end 48-2 of square spindle 48 drivably engages body 52-1 of coupling mechanism 52. A snap ring 68 is inserted into a snap ring groove 62-3 of locking spindle tail 62. The resulting assembled arrangement of spindle assembly 46 is illustrated in FIG. 5.

Each of the outer square spindle 48 of spindle assembly 46 and the inner locking spindle link 66 of locking spindle assembly 50 that is received in longitudinal bore 48-3 of square spindle 48 is made of a material having a relatively high melting temperature, such as steel or similar alloy. However, each of locking spindle tail 62 and locking actuator spindle 64 is made of a non-steel material, such as zinc, aluminum, polymer, or non-ferrous suitable alloy, having a relatively lower melting temperature.

Thus, in case of a fire, locking spindle tail 62 and locking actuator spindle 64 will melt away, rendering lock assembly 10 inoperable using exterior operator handle 28, i.e., a rotation of exterior operator handle 28 cannot retract bolt 56 of latch assembly 18. However, advantageously, the fire-resistant locking spindle link 66 of locking spindle assembly 50 remains in longitudinal bore 48-3 of square spindle 48, thus completely obstructing the passage through longitudinal bore 48-3 of square spindle 48. Since locking spindle link 66 does not melt away, locking spindle link 66 will remain in the middle of otherwise hollow square spindle 48 to aid in blocking the transfer of fire and/or heat through square spindle 48, and thus aiding in blocking the transfer of fire and/or heat through door 12.

Thus, with locking spindle assembly 50, the locking spindle link 66, e.g., made of steel, is configured to inhibit the spreading of fire and/or heat through door 12 during a fire condition, while locking spindle tail 62 and locking actuator spindle 64, e.g., made of non-steel material having a lower melting temperature than that of locking spindle link 66, are configured to deliver the required functional torque to lock and unlock lock assembly 10 by motor drive assembly 44 during normal operation.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lock assembly for a door, comprising:

an exterior operator assembly having an exterior operator handle;

an interior operator assembly having an interior operator handle;

a latch assembly having a bolt actuator mechanism and a bolt;

an outer spindle operatively coupled to the latch assembly, drivably coupled to the interior operator assembly, and the outer spindle having a longitudinal bore;

a coupling mechanism drivably coupled to the outer spindle;

a drive assembly configured to provide a driving rotation; and a locking spindle assembly rotatably received in the longitudinal bore, drivably engaged with the drive assembly, and configured to selectively operate the coupling mechanism to drivably couple the exterior operator assembly to the outer spindle upon actuation of the drive assembly, the locking spindle assembly having a fire compliant component made of a first material that melts during a fire to prevent operation of the latch assembly with the exterior operator assembly, and having a fire resistant component made of a second material having a higher melting temperature from that of the first material and configured to block the longitudinal bore of the outer spindle to aid in preventing the spread of the fire through the door via the longitudinal bore.

2. The lock assembly of claim 1, wherein the fire compliant component of the locking spindle assembly is made from a zinc material, and the fire resistant component of the locking spindle assembly and the outer spindle are made from a steel material.

3. The lock assembly of claim 1, wherein the locking spindle assembly comprises:

a locking spindle tail member that extends from a first end of the outer spindle, and configured to be drivably coupled to the drive assembly;

a locking actuator spindle that extends from a second end of the outer spindle, and configured to operate the coupling mechanism; and a locking spindle link configured to couple the locking spindle tail member to the locking actuator spindle, the locking spindle link being positioned within the longitudinal bore of the outer spindle, wherein the fire compliant component comprises the locking spindle tail member and the locking actuator spindle, and the fire resistant component comprises the locking spindle link.

4. The lock assembly of claim 1, wherein the locking spindle assembly comprises:

a locking spindle tail member having a first portion configured to be received in the longitudinal bore of the outer spindle;

a locking actuator spindle having a second portion configured to be received in the longitudinal bore of the outer spindle; and a locking spindle link having a first coupling portion configured to connect to the first portion of the locking spindle tail member and having a second coupling portion configured to connect to the second portion of the locking actuator spindle, the locking spindle link being positioned within the longitudinal bore of the outer spindle.

5. The lock assembly of claim 4, wherein the fire compliant component is at least one of the locking spindle tail member and the locking actuator spindle, and the fire resistant component is at least the locking spindle link.

6. The lock assembly of claim 4, wherein each of the locking spindle tail member and the locking actuator spindle is made of the first material, and each of the outer spindle and the locking spindle link is made of the second material.

7. The lock assembly of claim 6, wherein the first material is a zinc material and the second material is a steel material.

8. The lock assembly of claim 1, wherein the locking spindle assembly comprises:

a locking spindle tail member with a first coupling end having a first pair of diametrically opposed surface recesses;

a locking actuator spindle with a second coupling end having a second pair of diametrically opposed surface recesses; and a locking spindle link configured as an H-shaped structure having a pair of axially opposed U-shaped clip ends that are separated by an interposed solid core, a first U-shaped clip end of the pair of axially opposed U-shaped clip ends includes a first pair of diametrically opposed inwardly facing protrusions sized and configured to engage the corresponding first pair of diametrically opposed surface recesses of the locking spindle tail member, so as to connect the locking spindle link to the locking spindle tail member, and a second U-shaped clip end of the pair of axially opposed U-shaped clip ends includes a second pair of diametrically opposed inwardly facing protrusions sized and configured to engage the corresponding second pair of diametrically opposed surface recesses of the locking actuator spindle, so as to connect the locking spindle link to the locking actuator spindle.

9. The lock assembly of claim 8, wherein the fire compliant component is both of the locking spindle tail member and the locking actuator spindle, and the fire resistant component is the locking spindle link.

10. The lock assembly of claim 8, wherein both of the locking spindle tail member and the locking actuator spindle is made from a zinc material, and both of the outer spindle and the locking spindle link is made from a steel material.

11. A spindle assembly for use in a lock assembly, comprising:

an outer spindle having a longitudinal bore; and a locking spindle assembly rotatably received in the longitudinal bore of the outer spindle, the locking spindle assembly having a fire compliant component and a fire resistant component, wherein the fire compliant component is made of a first material that melts in the event of a fire, and the fire resistant component is made from a second material having a higher melting temperature than that of the first material and configured to block the longitudinal bore of the outer spindle after the melting of the fire compliant component to aid in preventing the spread of the fire through the longitudinal bore.

12. The spindle assembly of claim 11, wherein the fire compliant component is made from a zinc material, the fire resistant component is made from a steel material, and the outer spindle is made from a steel material.

13. The spindle assembly of claim 11, wherein the locking spindle assembly comprises:

a locking spindle tail member comprised of the first material, and extends from a first end of the outer spindle;

a locking actuator spindle comprised of the first material, and extends from a second end of the outer spindle; and a locking spindle link comprised of the second material, and configured to couple the locking spindle tail member to the locking actuator spindle, the locking spindle link being positioned within the longitudinal bore of the outer spindle.

14. The spindle assembly of claim 11, wherein the locking spindle assembly comprises:

a locking spindle tail member having a first portion configured to be received in the longitudinal bore of the outer spindle;

a locking actuator spindle having a second portion configured to be received in the longitudinal bore of the outer spindle; and a locking spindle link having a first coupling portion configured to connect to the first portion of the locking spindle tail member and having a second coupling portion configured to connect to the second portion of the locking actuator spindle, the locking spindle link being positioned within the longitudinal bore of the outer spindle, wherein the fire compliant component is at least one of the locking spindle tail member and the locking actuator spindle, and the fire resistant component is at least the locking spindle link.

15. The spindle assembly of claim 14, wherein each of the locking spindle tail member and the locking actuator spindle is made of the first material, and each of the outer spindle and the locking spindle link is made of the second material.

16. The spindle assembly of claim 15, wherein the first material is a zinc material and the second material is a steel material.

17. The spindle assembly of claim 11, wherein the locking spindle assembly comprises:

a locking spindle tail member with a first coupling end having a first pair of diametrically opposed surface recesses;

a locking actuator spindle with a second coupling end having a second pair of diametrically opposed surface recesses; and a locking spindle link configured as an H-shaped structure having a pair of axially opposed U-shaped clip ends that are separated by an interposed solid core, a first U-shaped clip end of the pair of axially opposed U-shaped clip ends includes a first pair of diametrically opposed inwardly facing protrusions sized and configured to engage the corresponding first pair of diametrically opposed surface recesses of the locking spindle tail member, so as to connect the locking spindle link to the locking spindle tail member, and a second U-shaped clip end of the pair of axially opposed U-shaped clip ends includes a second pair of diametrically opposed inwardly facing protrusions sized and configured to engage the corresponding second pair of diametrically opposed surface recesses of the locking actuator spindle, so as to connect the locking spindle link to the locking actuator spindle.

18. The spindle assembly of claim 17, wherein the fire compliant component is both of the locking spindle tail member and the locking actuator spindle, and the fire resistant component is the locking spindle link.

19. A lock assembly for use with a door, comprising:

an exterior operator assembly having an exterior operator handle;

an interior operator assembly having an interior operator handle;

an electronics assembly including a credential reader and a motor drive assembly electrically coupled to the credential reader, the credential reader configured to selectively actuate the motor drive assembly;

a latch assembly having a bolt actuator mechanism and a bolt;

an outer spindle operatively coupled to the bolt actuator mechanism of the latch assembly, and drivably coupled to the interior operator assembly, the outer spindle having a longitudinal bore;

a coupling mechanism drivably coupled to the outer spindle, and configured to selectively couple the exterior operator assembly to the outer spindle; and a locking spindle assembly rotatably received in the longitudinal bore of the outer spindle, the locking spindle including:

a locking spindle tail member having a first portion configured to be received in the longitudinal bore of the outer spindle, the locking spindle tail member being drivably coupled to the motor drive assembly;

a locking actuator spindle having a second portion configured to be received in the longitudinal bore of the outer spindle, and the locking actuator spindle configured to selectively operate the coupling mechanism to drivably couple the exterior operator assembly to the outer spindle upon actuation of the motor drive assembly; and a locking spindle link having a first coupling portion configured to connect to the first portion of the locking spindle tail member and having a second coupling portion configured to connect to the second portion of the locking actuator spindle, the locking spindle link being positioned within the longitudinal bore of the outer spindle, wherein each of the locking spindle tail member and the locking actuator spindle is made of the a first material configured to melt in the event of a fire, and the locking spindle link is made of a second material having a higher melting temperature than the first material and configured to block the longitudinal bore of the outer spindle to aid in preventing the spread of the fire through the door via the longitudinal bore of the outer spindle.

20. The lock assembly of claim 19, wherein:

the locking spindle tail member has a first coupling end having a first pair of diametrically opposed surface recesses;

the locking actuator spindle has a second coupling end having a second pair of diametrically opposed surface recesses; and the locking spindle link is configured as an H-shaped structure having a pair of axially opposed U-shaped clip ends that are separated by an interposed solid core, a first U-shaped clip end of the pair of axially opposed U-shaped clip ends includes a first pair of diametrically opposed inwardly facing protrusions sized and configured to engage the corresponding first pair of diametrically opposed surface recesses of the locking spindle tail member, so as to connect the locking spindle link to the locking spindle tail member, and a second U-shaped clip end of the pair of axially opposed U-shaped clip ends includes a second pair of diametrically opposed inwardly facing protrusions sized and configured to engage the corresponding second pair of diametrically opposed surface recesses of the locking actuator spindle, so as to connect the locking spindle link to the locking actuator spindle.

* * * * *